United States Patent [19]

Ben-Dov

[11] 4,317,122

[45] Feb. 23, 1982

[54] DUOPYRAMID CIRCULARLY POLARIZED BROADCAST ANTENNA

[75] Inventor: Oded Ben-Dov, Medford, N.J.

[73] Assignee: RCA Corporation, New York, N.Y.

[21] Appl. No.: 179,155

[22] Filed: Aug. 18, 1980

[51] Int. Cl.[3] ..... H01Q 21/26

[52] U.S. Cl. ..... 343/798; 343/885; 343/890

[58] Field of Search ..... 343/797, 798, 885, 890, 343/727, 730

[56] References Cited

U.S. PATENT DOCUMENTS

| | | | |
|---|---|---|---|
| 2,512,137 | 6/1950 | Buchwalter et al. | 343/797 |
| 3,428,923 | 2/1969 | Webb | 343/885 |
| 3,518,692 | 6/1970 | Kuecken | 343/797 |
| 3,702,479 | 11/1972 | Uhrig | 343/705 |
| 3,725,943 | 4/1973 | Spanos | 343/797 |
| 3,896,450 | 7/1975 | Fitzroy et al. | 343/797 |
| 4,011,567 | 3/1977 | Ben-Dov | 343/853 |
| 4,083,051 | 4/1978 | Woodward | 343/797 |
| 4,109,255 | 8/1978 | Silliman | 343/853 |

OTHER PUBLICATIONS

RCA Data Sheet, AVAG-1 VHF Circularly Polarized Antenna, Apr. 1948.

Jampro Antenna Co. Catalog, Apr. 1, 1973.

*Primary Examiner*—Eli Lieberman

*Attorney, Agent, or Firm*—Eugene M. Whitacre; Paul J. Rasmussen; William H. Meise

[57] ABSTRACT

A circularly polarized broadcast antenna includes a vertical mast and a plurality of bays spaced along the mast. Each bay includes at least one crossed dipole fed in quadrature mounted adjacent the mast. Each bay also includes a sleeve which may be λ/2 long disposed about the mast to act as a choke to prevent induced current flow on the mast. Current flow in the sleeve creates a vertically-polarized field component which perturbs the directly radiated field and increases the axial ratio. A polarizer is mounted orthogonal to the mast, and the currents induced in the polarizer are orthogonal to and in phase quadrature with the reradiated field of the sleeve to improve the axial ratio.

9 Claims, 9 Drawing Figures

DUOPYRAMID CIRCULARLY POLARIZED BROADCAST ANTENNA

BACKGROUND OF THE INVENTION

This invention relates to a circularly polarized broadcast television antenna having crossed dipoles arrayed about a support mast.

Television transmission standards have long required horizontally polarized broadcast transmission. In horizontal polarization, the electric (E) vector of the transmitted TEM wave is oriented horizontally. It has been proposed that television reception might be improved for the average viewer if the broadcast signal were circularly-polarized (CP) rather than horizontally polarized. In CP, two orthogonal planes of polarization are excited at the same frequency but with a 90° or quarter-wavelength ($\lambda/4$) displacement between the polarizations. This results in an electric vector which in effect rotates at the carrier frequency as it propagates. Some of the advantages of CP reception to the viewer are stated to be ease in adjusting rabbit-ear antennas and, under some circumstances, a reduction in ghosting resulting from multipath transmission.

Broadcast antennas for generating circular polarization are known. For example, U.S. Pat. No. 4,011,567 issued Mar. 8, 1977 to Ben-Dov describes a broadcast antenna for producing CP radiation. This antenna uses a circular array of helices wound about and driven relative to a support mast.

It is also known to use slanted dipoles (dipoles oriented at an angle of 45° from the vertical) in a circular array about a central support mast for generating CP. Each dipole thus oriented produces an E-vector at a 45° to the support mast. This E-vector may be resolved into vertical and horizontal components which propagate away from the dipole. The horizontally polarized component is virtually unaffected by the presence of the support mast, but the vertically polarized component interacts with the mast. This interaction leads to reradiation by the mast, possibly along its entire length. The field reradiated by the mast adds vectorially to the vertical component of the field radiated directly by the slanted dipole. Since the mast has a large aperture, the reradiated field varies sharply in magnitude with observation angle, and therefore the sum field will exhibit irregular peaks and nulls which adversely affect the perfection of the circular polarization (also known as axial ratio or AR).

Other arrangements for generating circular polarization are known. For example U.S. Pat. No. 4,109,255 to Silliman describes pairs of bent dipoles or helical loops fed in phase opposition to produce omnidirectional radiation which is circularly polarized. In normal use, such antennas are mounted alongside a support tower, and the degradation of the vertically polarized portion of the radiation pattern is accepted.

A simple and inexpensive transmitting antenna is desired which is circularly polarized in the presence of its support structure and which has low wind loading.

SUMMARY OF THE INVENTION

An elliptically polarized antenna includes a crossed dipole fed to produce an elliptically polarized directly radiated field having a low axial ratio and also includes a conductive vertical support mast. The crossed dipole is mounted to the mast, whereby currents induced in the mast create vertically polarized reradiation which perturbs the vertical component of the directly radiated field, which undesirably increases the axial ratio. A conductive sleeve is disposed about the mast in the region of the crossed dipole and is dimensioned to act as a choke for reducing the currents induced in the mast for reducing the axial ratio. However, current flow in the sleeve itself produces a vertically polarized second reradiated field which continues to perturb the vertical component of the directly radiated field and maintains the axial ratio higher than desired. An elongated polarizing element is mounted perpendicular to the mast and has currents induced in it. The currents induced in the polarizing element produce a horizontally polarized third reradiated field which, in a direction orthogonal to both the axis of the mast and to the polarizing element, corrects the circularity to produce a low axial ratio.

DESCRIPTION OF THE INVENTION

Figure 1:
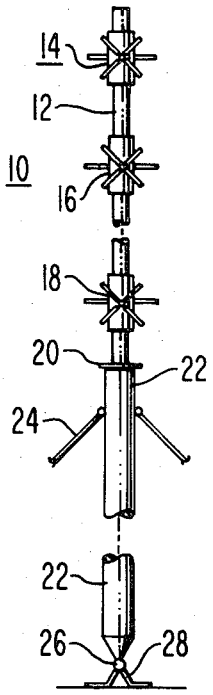
FIGS. 1 and 6 illustrate a broadcast antenna embodying the invention mounted upon a tower.

In FIG. 1, an antenna designated generally as 10 includes the support mast 12 and multiple bays 14–18 of an antenna according to the invention. Each bay as is known is spaced by about one wavelength from the next. Mast 12 is coupled by means of a flange 20 to a vertical tower 22 which supports the antenna at an appropriate height above ground. Tower 22 is supported on a pivot joint 26 relative to a bottom mounting 28 to allow for bending due to wind loading. Guy wires 24 aid in preventing excessive movement of the tower. In such arrangements, the amount of wind loading created by the multiple bays of the antenna must be minimized to eliminate the need for massive support structures. However, such reduced wind loading may not be achieved at the expense of degraded electrical performance.

Figure 2:
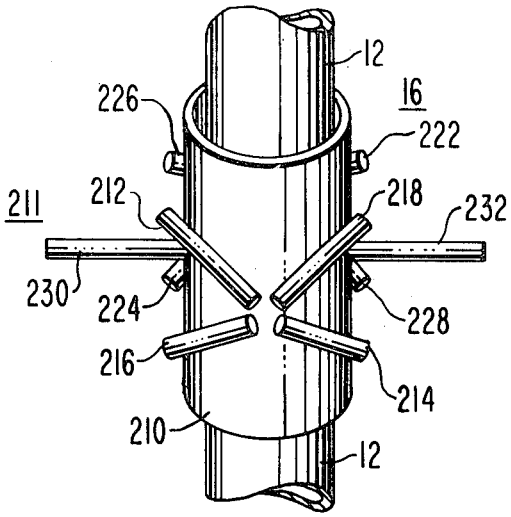
FIG. 2 is a perspective view of one bay of the antenna of FIG. 1.

FIG. 2 illustrates a typical bay 16 in perspective view. Bay 16 includes a conductive sleeve 210 spaced from mast 12 and dimensioned to act as a choke at the transmitter carrier frequency. This length may typically be about one-half wavelength ($\lambda/2$) at the broadcast carrier frequency. Between the viewer and sleeve 210 in FIG. 2 is a crossed dipole designated generally as 211 which is formed from a first dipole (dipole elements 212 and 214) and a second dipole (dipole elements 216 and 218). The support and feed-point connections of crossed dipole 211 are not shown so as to improve the clarity of FIG. 2.

Also shown in FIG. 2 are the ends of the elements 222–228 of a crossed dipole situated on the side of sleeve 210 opposite the viewer. Additionally, FIG. 2 shows polarizing elements 230 and 232 mounted orthogonal to the mast halfway between the first and second crossed dipoles.

Figure 3A:
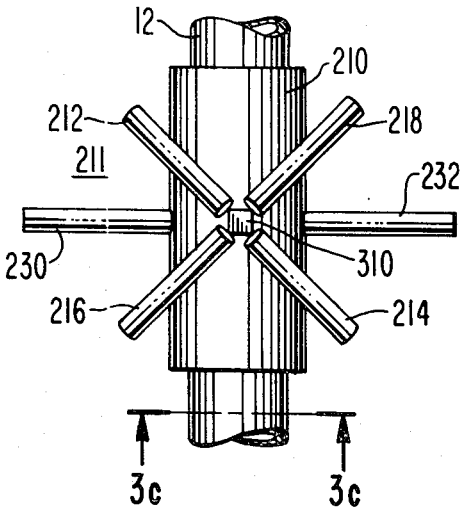
FIGS. 3*a*, 3*b* and 3*c* include three views of the bay of FIG. 2.

FIG. 3 illustrates the bay of FIG. 2 in greater detail. In FIG. 3*a*, the mounting by which crossed dipole 211 is affixed to the mast is shown as a block and is designated as 310. The view of FIG. 3*a* makes it clear that the projected angle between the first dipole 212–214 and the second dipole 216–218 is 90°. Each dipole, then, is 45° from a vertical plane parallel to the axis of the mast or the axis of sleeve 210. Also in FIG. 3*a*, it will be seen that sleeve 210 is elongated vertically, and the polarizing elements 230–232 are mounted in a horizontal plane.

Figure 3B:
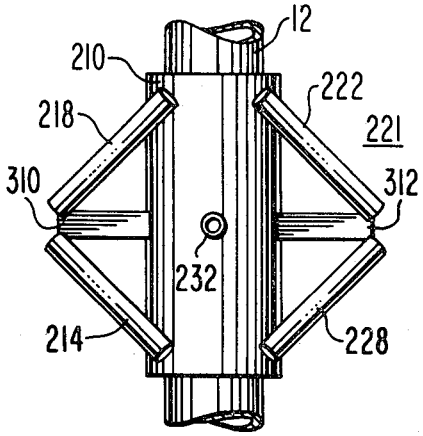
Figure 3C:
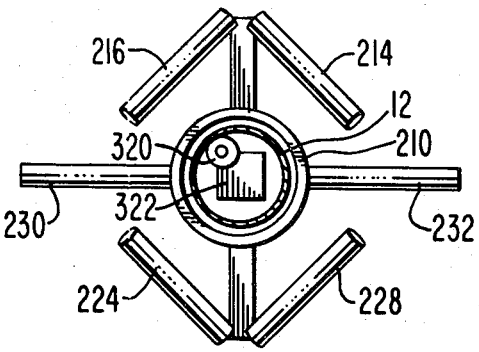

In the view of FIG. 3*b*, the end of polarizing element 232 is seen as a circle. The projected angle formed between a dipole element and a vertical plane parallel to the axis of the mast is approximately 45° in this view, also. Thus, elements 218 and 228 are approximately parallel as projected in the plane of the view although they are actually skewed as shown in FIG. 2. Similarly, in the plane of the view of FIG. 3*b* the angle between element 214 of the first dipole and element 218 of the second dipole is 90°. The support structure 310 by which crossed dipole 211 is supported is illustrated as an elongated structure in the view of FIG. 3*b*, and similarly the support structure for the second crossed dipole 221 is illustrated as an elongated element 312. The section view of FIG. 3*c* illustrates the dipole and polarizer elements, and also shows more clearly that sleeve 210 is spaced from mast 12. Within mast 12, a coaxial cable 320 is seen in section. Cable 320 carrier power from a source at the bottom of the mast to the various elements. At each bay, a feed structure shown as a block 322 includes phase shifters, power dividers, tuning elements and the like by which the various dipole elements are fed in known manner with signals for producing currents having the amplitudes and phases to be described. It will be noted that the projected area of the structure shown in FIG. 3 is relatively small, and therefore affords low wind loading.

Figure 4A:
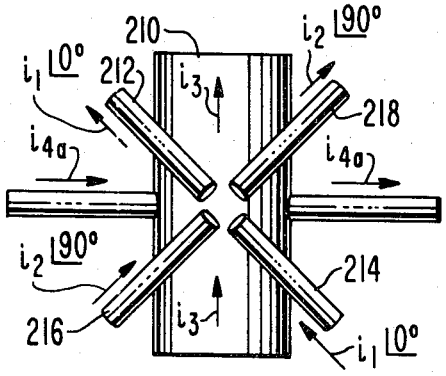
FIG. 4 illustrates instantaneous current directions on the structure of the corresponding views of FIG. 3.
Figure 4B:
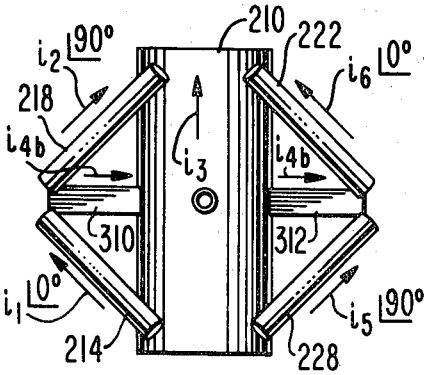

FIGS. 4*a* and 4*b* correspond to FIGS. 3*a* and 3*b* and include instantaneous current direction information. In FIG. 4*a*, the dipole consisting of elements 212 and 214 is fed with signals having an amplitude and phase for producing an instantaneous current illustrated as I1. The phase of current I1 is assigned to be 0° for reference. Dipole elements 212 and 214 are fed from opposite-polarity portions of the source of I1. Consequently, current I1 flows towards the extreme end of element 212 while current I1 flows towards the generator end of element 214. The phase designation relates only to the relative delay of the source. By comparison, the second dipole of crossed dipole 211 is fed with signals of the same amplitude as the first dipole but with a phase delay or shift of 90° relative to the signals generating current I1. At the instant shown, an induced vertical current I3 is assumed in sleeve 210. This induced current is as a result of the vertical components of either currents I1 or I2, or both. For our purposes, the phase of current I3 may be assumed to be somewhat indeterminate, in that it depends upon the spacing of crossed dipole 211 from the sleeve, the exact length of the sleeve and the like. Because of their symmetrical disposition, the polarizing elements 230 and 232 have induced in them currents I4*a* having equal magnitudes.

In the view of FIG. 4*b*, current I1/0° and I2/90° as already defined in dipole elements 214 and 218 are illustrated. Current I3 induced in sleeve 210 is the same current as that shown in FIG. 4*a*. Dipole element 222 is part of a dipole including elements 222 and 224 which is fed with a current I6 equal in magnitude to current I1 and with the same delay. Consequently, current I6 is marked as being phase 0°. However, dipole element 222 is connected to the opposite feed polartiy as compared with dipole element 214, and consequently instantaneous current I1 as illustrated in FIG. 3*b* is leaving the end of the dipole while current I6 is entering. Similarly, dipole element 228 carries a current I5 which is delayed By 90° with respect to currents I1 or I6. Dipole element 228 is connected to the source of current I5 in such a manner that at the instant shown current I5 is leaving the dipole, whereas current I2 is entering dipole 218.

In operation, along the viewing axis illustrated in FIG. 4*a* (orthogonal to the axes of sleeve 210 and to polarizing elements 230–232), the far field is composed of a /0° component attributable to I1 and a /90° component attributable to I2, together with a vertically polarized (reradiated) component attributable to induced current I3. The far-field reradiation attributable to induced current I3 will have some amplitude and phase relative to the directly radiated field resulting from currents I1 and I2. Similarly, there will be a horizontally polarized reradiated field resulting from induced current I4. From considerations of symmetry, it will be recognized that if the basic directly radiated field is circularly polarized, the reradiated field of orthogonal components could also be circularly polarized, and will add to the directly radiated field in such a manner as to maintain a low axial ratio. In the far field in the direction of the viewing axis of FIG. 4*b*, a directly radiated field results from the effective dipole pairs 218–228, 214–222. The reradiated field attributable to current I3 continues to be vertically polarized in the direction of the view of FIG. 4*b*. However, current I4*a* can contribute no radiated field in this direction. However, support structure 310 and 312 will have induced currents which by symmetry will be substantially equal to currents I4. The induced currents in supports 310 and 312 are illustrated and designated as I4*b*. Consequently, support structure 310–312 will radiate a horizontally polarized field having a phase and amplitude such that when summed with the reradiated field due to current I3 and the directly radiated field produces elliptical polarization with low axial ratio. Consequently, the support structure 310–312 serves as a polarizing element in addition to providing support function for the direct-radiation dipoles and in addition to carrying feed cables. It will be recognized that in order to perform this function, the dipole elements must be electrically isolated from the ends of support structures 310 and 312, as by the use of a dielectric spacer (not shown) as is well known in the antenna art.

Figure 5:
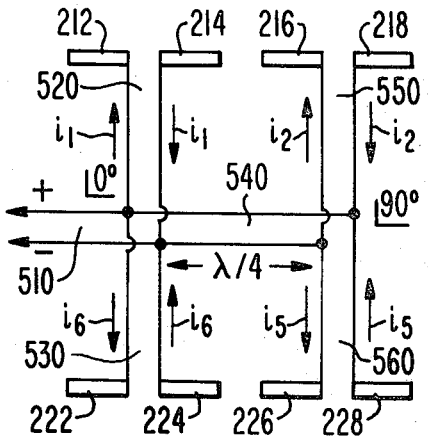
FIG. 5 illustrates schematically a feed arrangement for the bay illustrated in FIGS. 2–4.

In FIG. 5, a feed structure for the crossed dipoles is shown in schematic detail. In FIG. 5, elements 212 and 214 of the first dipole and elements 216 and 218 of the second dipole are shown at the top, and elements 222–228 of the second crossed dipole are shown at the bottom. A transmission line illustrated as a two-wire line 510 having instantaneous polarities as shown is driven from a source of signals, not shown. As described, elements 214 and 222 are driven from opposite polarities at a reference phase of 0°. Element 212 is driven in parallel with element 222, and element 214 is driven in parallel with element 224. It should be noted that the length of the transmission lines 520–560 by which each of the dipoles are connected to transmission line 510 are equal. Transmission line 510 is also connected to a further transmission-line element illustrated as a two-wire line 540 having a length of $\lambda/4$ which introduces the desired 90° phase shift or delay between the drive to elements 212, 214, 222, 224 and the drive to elements 216, 218, 226, 228. Reference current directions are illustrated in FIG. 5 for ease of comparison with FIG. 4.

While the described embodiment provides circular polarization in an azimuthally-omnidirectional manner, it will be recognized that by the use of a single crossed dipole such as 211 together with a sleeve 210 and polarizers 230–232 that an elliptically-polarized field of low axial ratio can be generated in at least one direction. This may be useful where, for example, the sites where broadcast reception is desired are on one side of the antenna location.

In principle, polarizing elements 230 and 232 and support structure 310–312 need be affixed only to sleeve 210, because the far-field effects of the current flow upon the surfaces cannot be perturbed by currents flowing within sleeve 210 or mast 12. Practically, however, it must be recognized that the dipole elements must be fed from a source remote from the antenna, and the feed cables must come through the side of the mast through mounting elements 310 and 312 to the dipoles. If the outer conductor of the coaxial feed cable is not grounded to the mast at the point where it exits, uncontrolled resonant cavities are formed within the mast which are coupled to the radiating source by unavoidable assymetries in the construction. This may cause perturbations of the impedance match and may result in assymetrical current distributions which can affect the far field. Consequently, it is desirable to connect the feed transmission lines to the mast, and therefore feed structures 310 and 312 are preferably grounded to the mast. For the sake of symmetry, polarizing elements 230 and 232 should also connect through sleeve 210 to the mast. For ease in construction, sleeve 210 should also be electrically connected at its center ($\lambda/4$ from each end of the sleeve) to both the support structures and to the polarizers. When the length of sleeve 210 is $\lambda/2$, such grounding has no effect whatever because the center point of the sleeve is a low impedance point anyway.

Figure 6:
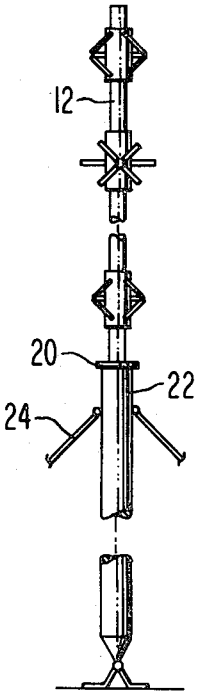

As is known, the AR of the field of each bay may have some value of circularity other than OdB at certain azimuthal points on the horizon. It may be expected that each bay will display a similar performance, due to mechanical similarities of each bay. Since the total radiated field of a multibay antenna results from the superposition of the field of each bay, it is possible to improve the Ar of the far-field radiation pattern by positioning each bay in a different rotational position about the support mast, as illustrated in FIG. 6. This tends to average the circularity error of the bays and results in an improved AR for the entire multibay antenna.

Other embodiments of the invention will be apparent to those skilled in the art. In particular, dipole and stub dimensions may be other than $\lambda/4$ and $\lambda/2$, respectively. The dimensions of the polarizer may be made to more closely approximate the dimensions of the stub for improved symmetry, and such an enlarged polarizer may be skeletonized in known fashion. The dipole bandwidth may be increased by use of elements enlarged at the ends, and may then also be skeletonized. The spacing between bays may as is known be adjusted for proper impedance, pattern or both and tuning elements may be used to improve the impedance match of each dipole.

Additionally, vertical stubs may be mounted at points along the dipole elements. The power of the signal applied to particular dipoles may also be adjusted by use of attenuators to correct for the effects of minor asymmetries of construction. Similarly, the angle made by each dipole element may be varied somewhat from 45° from the support mast to achieve the desired compromise of impedance, omnidirectionality and axial ratio. The dipole elements may be arcuate rather than straight, as described in the aforementioned Silliman patent.

What is claimed is:

1. A circularly or elliptically polarized antenna including a conductive support mast, comprising:

first and second crossed dipoles disposed on opposite sides of the mast, the dipole elements being displaced by about 45° from first and second vertical planes parallel with the axis of said mast for radiating a CP field whereby currents are induced in said mast which perturb the vertical component of the radiated field;

a conductive sleeve fitted about said mast in the region of said first and second crossed dipoles for forming a choke for reducing current flow in said mast, whereby currents induced in said sleeve contribute a vertically polarized component to said radiated field which increases the axial ratio; and a polarizer element coupled to said sleeve and oriented perpendicular to said mast for producing as a result of induced currents a horizontally polarized field which reduces the axial ratio.

2. An elliptically polarized antenna, comprising:

a first crossed dipole fed to produce an elliptically polarized directly radiated field of low axial ratio;

a vertical conductive support mast;

first mounting means for mounting said crossed dipole to said mast, whereby currents induced in said mast create vertically polarized reradiation which perturbs the vertical component of said directly radiated field whereby the axial ratio is undesirably increased;

a conductive sleeve disposed about said mast in the region of said crossed dipole and dimensioned to act as a choke for reducing said currents induced in said mast and reducing said axial ratio, whereby current flow in said sleeve produces a vertically polarized second reradiated field which perturbs said vertical component of said directly radiated field and increases said axial ratio; and an elongated polarizing element mounted perpendicular to said mast for producing as a result of currents induced in said polarizing element a horizontally polarized third reradiated field which in conjunction with said second reradiated field improves said axial ratio in a direction orthogonal to both said axis of said mast and said polarizing element.

3. An antenna as in claim 2, further comprising:

a second crossed dipole;

second mounting means for mounting said second crossed dipole on the side of said mast opposite the side on which said first crossed dipole is mounted; and wherein the elements of said dipoles are displaced by about 45° from first and second orthogonal vertical planes parallel to the axis of said mast.

4. An antenna as in claim 3, wherein:

said first and second mounting means are oriented perpendicular to said mast and 90° around said mast from said polarizer element and are dimensioned in a manner similar to that of said polarizer element for producing a fourth reradiated field which in conjunction with said second reradiated field improves said axial ratio in a direction orthogonal to both said axis of said mast and the axes of said mounting means.

5. An antenna as in claims 2, 3 or 4 wherein the dipoles of each of said crossed dipoles are fed in phase quadrature.

6. An antenna as in claims 3 or 4 wherein each dipole of said first crossed dipole is fed in the same phase as a dipole of said second crossed dipole.

7. A multibay elliptically polarized antenna supported by a vertical conductive support mast, each bay of which comprises:

a first crossed dipole fed to produce an elliptically polarized directly radiated field of low axial ratio along an axis;

first mounting means for mounting said crossed dipole to the mast, whereby currents induced in said mast create vertically polarized reradiation which perturbs the vertical component of said directly radiated field whereby the axial ratio is undesirably increased;

a conductive sleeve disposed about said mast in the region of said crossed dipole and dimensioned to act as a choke for reducing said currents induced in said mast and reducing said axial ratio, whereby current flow in said sleeve produces a vertically polarized second reradiated field which perturbs said vertical component of said directly radiated field and increases said axial ratio; and an elongated polarizing element mounted perpendicular to said mast for producing as a result of currents induced in said polarizing element a horizontally polarized third reradiated field which in conjunction with said second reradiated field improves said axial ratio in a direction orthogonal to both said axis of said mast and said polarizing element.

8. A multibay elliptically polarized antenna according to claim 1 wherein each of the bays further comprises:

a second crossed dipole fed to produce an elliptically polarized direct radiated field of low axial ratio along an axis;

second mounting means for mounting said second crossed dipole to a side of said mast opposite that side to which said first crossed dipole is mounted.

9. A multibay antenna according to claims 1 or 2 wherein the azimuthal radiation pattern of each of said bays includes regions of low axial ratio and regions of higher axial ratio, and wherein in order to improve said region of higher axial ratio said bays are mounted at various different circumferential positions about said mast.

* * * * *